US008881638B2

(12) United States Patent
Leeming

(10) Patent No.: US 8,881,638 B2
(45) Date of Patent: Nov. 11, 2014

(54) TEXTILE ARMOUR

(71) Applicant: Amsafe Bridport Limited, Bridport (GB)

(72) Inventor: David William Leeming, Swindon (GB)

(73) Assignee: Amsafe Bridport Limited, Bridport (GB)

( * ) Notice: Subject to any disclaimer, the term of this patent is extended or adjusted under 35 U.S.C. 154(b) by 0 days.

(21) Appl. No.: 13/851,856

(22) Filed: Mar. 27, 2013

(65) Prior Publication Data

US 2013/0305913 A1 Nov. 21, 2013

Related U.S. Application Data

(63) Continuation of application No. 13/187,079, filed on Jul. 20, 2011, now Pat. No. 8,443,708, which is a continuation of application No. 10/584,605, filed on Aug. 9, 2007, which is a continuation of application No. PCT/GB2007/000329, filed on Jan. 7, 2007.

(30) Foreign Application Priority Data

Jan. 17, 2006 (GB) ..... 0601030.0

(51) Int. Cl.

| | |
|---|---|
| ***F41H 5/02*** | (2006.01) |
| ***F41H 5/06*** | (2006.01) |
| ***F41H 5/013*** | (2006.01) |
| ***F41H 5/04*** | (2006.01) |

(52) U.S. Cl.

CPC ..... *F41H 5/0492* (2013.01); *F41H 5/026* (2013.01); *F41H 5/023* (2013.01); *F41H 5/06* (2013.01); *F41H 5/013* (2013.01)

USPC ..... 89/36.01; 114/241; 89/36.04; 89/36.07; 89/36.08; 89/36.09

(58) Field of Classification Search

CPC ..... F41H 5/026

USPC ..... 114/241

See application file for complete search history.

(56) References Cited

U.S. PATENT DOCUMENTS

| | | | | |
|---|---|---|---|---|
| 2,348,387 | A | 5/1944 | Hume | |
| 2,406,482 | A | 10/1946 | Riddle | |
| 2,697,054 | A * | 12/1954 | Dietz et al. | 428/110 |
| 3,069,796 | A * | 12/1962 | Benisch et al. | 428/17 |
| 3,132,433 | A | 5/1964 | Luketa | |

(Continued)

FOREIGN PATENT DOCUMENTS

| | | |
|---|---|---|
| AU | 2009271716 | 1/2010 |
| CA | 2645052 | 5/2008 |

(Continued)

OTHER PUBLICATIONS

*Armoured Vehicles in the News: Rosomak 8×8 Wheeled Armoured Vehicle*, TankNutDave.com, dated Nov. 2, 2010 (5 pages).

(Continued)

*Primary Examiner* — Samir Abdosh

(74) *Attorney, Agent, or Firm* — Perkins Coie LLP

(57) ABSTRACT

Textile armour (2) comprising at least one textile section (4) and corresponding supporting means (6), wherein the arrangement is such that the or each textile section is fully extended.

8 Claims, 2 Drawing Sheets

(56) References Cited

U.S. PATENT DOCUMENTS

| | | | | |
|---|---|---|---|---|
| 3,324,768 | A | 6/1967 | Eichelberger | |
| 3,969,563 | A * | 7/1976 | Hollis, Sr. | 428/175 |
| 3,995,525 | A * | 12/1976 | Blair | 86/22 |
| 4,186,817 | A * | 2/1980 | Bauer | 180/68.1 |
| 4,230,041 | A * | 10/1980 | Bailey et al. | 102/275.8 |
| 4,312,272 | A * | 1/1982 | Baker et al. | 102/275.8 |
| 4,358,984 | A | 11/1982 | Winblad | |
| 4,574,534 | A | 3/1986 | Beaton | |
| 4,635,962 | A * | 1/1987 | Miyada | 280/749 |
| 4,704,943 | A | 11/1987 | McDougal | |
| 4,934,245 | A * | 6/1990 | Musante et al. | 89/36.02 |
| 5,069,109 | A | 12/1991 | Lavan, Jr. | |
| 5,147,145 | A | 9/1992 | Facey et al. | |
| 5,197,239 | A | 3/1993 | Glynn et al. | |
| 5,223,664 | A * | 6/1993 | Rogers | 102/275.1 |
| 5,319,873 | A | 6/1994 | Krager | |
| 5,417,139 | A | 5/1995 | Boggs et al. | |
| 5,583,311 | A | 12/1996 | Rieger | |
| 5,703,316 | A | 12/1997 | Madden, Jr. | |
| 5,739,458 | A | 4/1998 | Girard | |
| 5,848,665 | A | 12/1998 | Rexroad et al. | |
| 5,898,125 | A | 4/1999 | Mangolds et al. | |
| 5,966,877 | A | 10/1999 | Hawes | |
| 6,021,703 | A | 2/2000 | Geiss et al. | |
| 6,029,558 | A | 2/2000 | Stevens et al. | |
| 6,063,716 | A | 5/2000 | Granqvist | |
| 6,279,449 | B1 | 8/2001 | Ladika et al. | |
| 6,323,145 | B1 | 11/2001 | Popper et al. | |
| 6,575,075 | B2 | 6/2003 | Cohen | |
| 6,599,649 | B2 | 7/2003 | Martin | |
| 6,626,077 | B1 * | 9/2003 | Gilbert | 89/1.11 |
| 6,666,124 | B2 | 12/2003 | Fleming | |
| 6,758,306 | B2 | 7/2004 | Walls et al. | |
| 6,843,197 | B1 * | 1/2005 | Nixon et al. | 114/241 |
| 6,904,838 | B1 | 6/2005 | Dindl | |
| 6,957,602 | B1 | 10/2005 | Koenig et al. | |
| 7,328,644 | B2 | 2/2008 | Vickroy | |
| 7,472,637 | B2 | 1/2009 | Sarva et al. | |
| 7,506,881 | B2 | 3/2009 | Leonard | |
| 7,571,493 | B1 | 8/2009 | Purvis et al. | |
| 7,628,104 | B2 | 12/2009 | Warren et al. | |
| 7,744,313 | B2 | 6/2010 | Terai et al. | |
| 7,819,050 | B1 | 10/2010 | MacDougall | |
| 7,866,250 | B2 * | 1/2011 | Farinella et al. | 89/36.17 |
| 7,886,646 | B2 | 2/2011 | Bannasch et al. | |
| 7,900,548 | B2 * | 3/2011 | Hoadley et al. | 89/36.17 |
| 7,926,407 | B1 | 4/2011 | Hallissy et al. | |
| 7,942,092 | B1 | 5/2011 | Kiel et al. | |
| 7,946,211 | B1 | 5/2011 | Winchester et al. | |
| 7,954,418 | B2 | 6/2011 | Gabrys | |
| 7,958,809 | B1 | 6/2011 | Bitar et al. | |
| 7,975,594 | B2 | 7/2011 | Wartmann | |
| 7,987,762 | B2 | 8/2011 | Joynt et al. | |
| 7,997,181 | B1 | 8/2011 | Tunis et al. | |
| 8,001,880 | B2 | 8/2011 | White et al. | |
| 8,006,605 | B2 | 8/2011 | Tunis et al. | |
| 8,006,606 | B1 | 8/2011 | Petrosillo et al. | |
| 8,011,285 | B2 | 9/2011 | Farinella et al. | |
| 8,015,910 | B1 | 9/2011 | Fuqua et al. | |
| 8,020,483 | B2 | 9/2011 | Benyami et al. | |
| 8,025,005 | B2 | 9/2011 | Pavon | |
| 8,037,802 | B2 | 10/2011 | Ciriscioli et al. | |
| 8,042,449 | B2 | 10/2011 | Farinella et al. | |
| 8,051,762 | B2 | 11/2011 | Beach et al. | |
| 8,056,463 | B2 | 11/2011 | Grove et al. | |
| 8,056,855 | B2 | 11/2011 | Konstantinovskiy | |
| 8,061,258 | B2 | 11/2011 | Hoadley et al. | |
| 8,074,554 | B1 | 12/2011 | MacDougall | |
| 8,082,835 | B2 | 12/2011 | Soukos | |
| 8,087,341 | B2 | 1/2012 | Adler | |
| 8,091,464 | B1 | 1/2012 | Imholt et al. | |
| 8,091,465 | B2 | 1/2012 | Ravid et al. | |
| 8,468,927 | B2 | 6/2013 | Malone et al. | |
| 2004/0177799 | A1 * | 9/2004 | Andersson et al. | 114/382 |
| 2006/0011054 | A1 | 1/2006 | Walthall et al. | |
| 2006/0014920 | A1 * | 1/2006 | Shirakawa et al. | 528/272 |
| 2006/0169832 | A1 * | 8/2006 | Glasson | 244/3.1 |
| 2006/0226406 | A1 * | 10/2006 | Vise et al. | 256/19 |
| 2007/0180983 | A1 * | 8/2007 | Farinella et al. | 89/36.07 |
| 2007/0214951 | A1 | 9/2007 | Swinson | |
| 2007/0218210 | A1 | 9/2007 | Althaus et al. | |
| 2007/0261542 | A1 * | 11/2007 | Chang et al. | 89/1.11 |
| 2008/0148929 | A1 | 6/2008 | Graphenius | |
| 2008/0164379 | A1 * | 7/2008 | Wartmann et al. | 245/8 |
| 2008/0307553 | A1 * | 12/2008 | Jbeili et al. | 2/2.5 |
| 2009/0035068 | A1 | 2/2009 | Terai et al. | |
| 2009/0095147 | A1 * | 4/2009 | Tunis et al. | 89/36.02 |
| 2009/0173250 | A1 * | 7/2009 | Marscher et al. | 102/438 |
| 2009/0217811 | A1 | 9/2009 | Leeming | |
| 2009/0235813 | A1 | 9/2009 | Cashin et al. | |
| 2009/0266226 | A1 * | 10/2009 | Beach et al. | 89/36.02 |
| 2009/0266227 | A1 * | 10/2009 | Farinella et al. | 89/36.02 |
| 2009/0308238 | A1 | 12/2009 | Schwartz | |
| 2010/0005644 | A1 | 1/2010 | Schneider et al. | |
| 2010/0102166 | A1 | 4/2010 | Konstantinovskiy | |
| 2010/0190608 | A1 | 7/2010 | Publicover et al. | |
| 2010/0279540 | A1 | 11/2010 | Shawcross et al. | |
| 2010/0285269 | A1 | 11/2010 | Telander | |
| 2010/0294122 | A1 | 11/2010 | Hoadley et al. | |
| 2010/0294123 | A1 | 11/2010 | Joynt et al. | |
| 2010/0294124 | A1 | 11/2010 | Wentzel | |
| 2010/0307328 | A1 * | 12/2010 | Hoadley et al. | 89/36.02 |
| 2010/0319524 | A1 | 12/2010 | Farinella et al. | |
| 2011/0048221 | A1 | 3/2011 | Jung et al. | |
| 2011/0059815 | A1 | 3/2011 | Jones | |
| 2011/0067561 | A1 | 3/2011 | Joynt | |
| 2011/0079135 | A1 | 4/2011 | Farinella et al. | |
| 2011/0107904 | A1 | 5/2011 | Queheillalt et al. | |
| 2011/0107905 | A1 | 5/2011 | Bourque | |
| 2011/0113952 | A1 | 5/2011 | Rosenwasser et al. | |
| 2011/0113953 | A1 | 5/2011 | Boczek et al. | |
| 2011/0114799 | A1 | 5/2011 | Ferraiolo et al. | |
| 2011/0115255 | A1 | 5/2011 | Boczek et al. | |
| 2011/0120294 | A1 | 5/2011 | Beach et al. | |
| 2011/0138993 | A1 | 6/2011 | Mariotti | |
| 2011/0138994 | A1 | 6/2011 | Joynt et al. | |
| 2011/0146739 | A1 | 6/2011 | Li | |
| 2011/0168001 | A1 | 7/2011 | Lee | |
| 2011/0174144 | A1 | 7/2011 | Kuchinsky et al. | |
| 2011/0174146 | A1 | 7/2011 | Carbajal | |
| 2011/0174147 | A1 | 7/2011 | Steeman et al. | |
| 2011/0179944 | A1 | 7/2011 | Farinella et al. | |
| 2011/0192014 | A1 | 8/2011 | Holmes, Jr. et al. | |
| 2011/0197747 | A1 | 8/2011 | Schneider et al. | |
| 2011/0203450 | A1 | 8/2011 | Carbajal et al. | |
| 2011/0203453 | A1 | 8/2011 | Farinella et al. | |
| 2011/0209606 | A1 | 9/2011 | Grove et al. | |
| 2011/0232468 | A1 | 9/2011 | Hembise et al. | |
| 2011/0232472 | A1 | 9/2011 | Kellner, Jr. et al. | |
| 2011/0259181 | A1 | 10/2011 | Lundquist et al. | |
| 2011/0259185 | A1 | 10/2011 | Berning et al. | |
| 2011/0260495 | A1 | 10/2011 | Hafften et al. | |
| 2011/0274486 | A1 | 11/2011 | White et al. | |
| 2011/0277621 | A1 | 11/2011 | Joynt | |
| 2011/0290105 | A1 | 12/2011 | Greenwood | |
| 2011/0303079 | A1 | 12/2011 | Joynt | |
| 2011/0314999 | A1 | 12/2011 | Luther et al. | |
| 2012/0006189 | A1 | 1/2012 | Leeming | |
| 2012/0011993 | A1 | 1/2012 | Malone et al. | |
| 2012/0247316 | A1 | 10/2012 | Farinella et al. | |
| 2012/0291616 | A1 | 11/2012 | Andrewartha et al. | |

FOREIGN PATENT DOCUMENTS

| | | |
|---|---|---|
| CN | 85107110 | 5/1987 |
| DE | 2409876 | 9/1975 |
| DE | 2507351 | 9/1976 |
| DE | 3337115 | 2/1988 |
| EP | 175914 | 4/1986 |
| EP | 1984693 | 10/2008 |
| EP | 2100086 | 9/2009 |
| EP | 2397808 | 12/2011 |
| GB | 11757 | 0/1914 |
| GB | 514577 | 11/1939 |

(56) References Cited

FOREIGN PATENT DOCUMENTS

| | | |
|---|---|---|
| GB | 518338 | 2/1940 |
| GB | 2449055 | 11/2008 |
| RU | 2125224 | 1/1999 |
| RU | 2199711 | 2/2003 |
| SE | 524809 | 10/2004 |
| WO | WO-2006034528 | 4/2006 |
| WO | WO-2006134407 | 12/2006 |
| WO | WO-2008063205 | 5/2008 |
| WO | WO-2008079001 | 7/2008 |
| WO | WO-2009064263 | 5/2009 |
| WO | WO-2010090661 | 8/2010 |
| WO | WO-2011156179 | 12/2011 |

OTHER PUBLICATIONS

*Dyneema*, Wikipedia, the free encyclopedia: located online at: http://en.wikipedia.org/wiki/Dyneema and printed on Dec. 7, 2005, (2 pages).
Final Office Action; U.S. Appl. No. 10/584,605; Mailing Date: Jan. 13, 2010 (12 pages).
Final Office Action; U.S. Appl. No. 10/584,605; Mailing Date: Jul. 20, 2010 (7 pages).
Final Office Action; U.S. Appl. No. 10/584,605; Mailing Date: Sep. 9, 2011 (5 pages).
Final Office Action; U.S. Appl. No. 10/584,605; Mailing Date: Mar. 23, 2011 (8 pages).
Final Office Action, U.S. Appl. No. 13/224,164; Mailing Date: Mar. 6, 2013 (9 pages).
*How Kevlar works: the secret behind protective Kevlar clothing, gloves, helmets*: Explain that Stuff, last updated Dec. 7, 2009, printed Apr. 20, 2010, located at http://www.explainthatstuff.com/kevlar.html (6 pages).
J. Lok, "Grenade Catcher," Defense Technology, International, dated Jun. 2007; pp. 14-16.
Non-Final Office Action; U.S. Appl. No. 10/584,605; Mailing Date: Mar. 10, 2010 (8 pages).
Non-Final Office Action; U.S. Appl. No. 10/584,605; Mailing Date: Jul. 9, 2009 (9 pages).
Non-Final Office Action; U.S. Appl. No. 10/584,605; Mailing Date: Jul. 29, 2011 (4 pages).
Non-Final Office Action; U.S. Appl. No. 10/584,605; Mailing Date: Oct. 19, 2010 (6 pages).
Non-Final Office Action; U.S. Appl. No. 10/584,605; Mailing Date: Jun. 13, 2011 (5 pages).
Non-Final Office Action; U.S. Appl. No. 13/187,079; Mailing Date: Jun. 25, 2012; (13 pages).
Non-Final Office Action; U.S. Appl. No. 13/111,888; Mailing Date Dec. 6, 2012; (17 pages).
*Rapid Polyethylene Military Plastic Injection Molding*, SmartSourcing, Inc., 2009 (2 pages).
*RPG Active Countermeasure*; IABS; Issue 1, dated 2004 and updated Oct. 12, 2005 (1 page).
*Ultra High Molecular Weight Polyethylene*, Wikipedia, the free encyclopedia; located at http://en.wikipedia.org/wiki/Ultra_high_molecular_weight_polyethylene and printed on Jul. 12, 2005, (2 pages).
Final Office Action; U.S. Appl. No. 13/187,079; Mailing Date: Jan. 17, 2013; (16 pages).
Non-Final Office Action; U.S. Appl. No. 13/271,031; Mailing Date: Feb. 26, 2013; (9 pages).
United States Patent and Trademark Office Patent Trial and Appeal Board, Decision—Motions—Bd. R. 125(a) in Patent Interference No. 105,862, Patent 7,975,594 v. U.S. Appl. No. 10/584,605, Feb. 25, 2013.
United States Patent and Trademark Office Patent Trial and Appeal Board, Judgment—Merits—Bd. R. 127 in Patent Interference No. 105,862, Patent 7,975,594 v. U.S. Appl. No. 10/584,605 Feb. 25, 2013.
Non-Final Office Action; U.S. Appl. No. 13/224,164; mailed Jan. 26, 2012, (11 pages).
Non-Final Office Action; U.S. Appl. No. 13/271,031; mailed Jan. 19, 2012 (9 pages).
Notice of Allowance: U.S. Appl. No. 13/862,182; mailed Feb. 6, 2014, (6 pages).
Non Final Office Action; U.S. Appl. No. 13/862,182; mailed Oct. 9, 2013, (9 pages).
Final Office Action; U.S. Appl. No. 13/224,164, mailed Sep. 27, 2013, (10 pages).
Final Office Action; U.S. Appl. No. 13/271,031, mailed Sep. 17, 2013, (9 pages).
Final Office Action; U.S. Appl. No. 13/851,856, mailed on Feb. 21, 2014, 5 pages.
Final Office Action; U.S. Appl. No. 13/851,856, mailed on Jul. 24, 2013, 10 pages.

* cited by examiner

TEXTILE ARMOUR

This application is a continuation of U.S. patent application Ser. No. 13/187,079, filed Jul. 20, 2011 and now pending, which is a continuation of U.S. patent application Ser. No. 10/584,605, filed Aug. 9, 2007 and now pending, which is a continuation under U.S.C. §365(c) of International Application No. PCT/GB2007/000329, filed Jan. 17, 2007, which claims priority to United Kingdom Patent Application No. 0601030.0, filed Jan. 17, 2006, the disclosures of which are incorporated herein by reference in their entireties.

The present invention relates to textile armour and to a textile armour system which may be utilised to protect a vulnerable target, such as a vehicle, building or other object, from damage caused by a shaped-charge warhead, such as a rocket propelled grenade (RPG).

Shaped-charge warheads, such as RPGs are capable of penetrating steel and armour and, therefore, pose a particular problem for tanks and armoured personnel carriers (APC) in combat situations. A shaped-charge warhead consists of a cone shaped warhead having a quantity of explosive disposed behind a hollow space. The hollow space is typically lined with a compliant material, such as copper. When detonated the energy is concentrated to the centre of the charge and it is sufficient to transform the copper into a thin, effectively liquid, shaped-charge jet having a tip speed of up to 12 $kms^{-1}$. The extremely high pressures generated cause the target material to yield and flow plastically, with devastating effect. To be most effective the shaped-charge has to detonate at the correct distance from the target. If it detonates too close to the target the shaped-charge jet will not have properly formed before hitting the surface and the effect will be lessened. Conversely, if the shaped-charge is detonated too far away from the target surface the shaped-charge jet will have diffused and, again, the effect is lessened.

The fact that shaped-charge warheads must be detonated at a particular distance from the target object has been commonly utilised in defence shields. By providing a preliminary shield at a short distance from the actual armour of the vehicle, or other structure, it is possible to cause the warhead to detonate at a safe distance from the actual armour, with the effect that the charge explodes between the preliminary shield and the armour. In effect, the warhead becomes a conventional grenade, rather than a shaped-charge.

Any preliminary shield which causes premature detonation of the shaped-charge will offer some degree of protection. The shield itself merely needs to cause detonation, it is not meant to act as additional armour. During World War II the German army fitted sheet metal skirts or "Schürzen" on to many of their tanks to act as a preliminary shield. In more recent times it has become common to fit so-called "slat armour" to tanks and other military vehicles. The slat armour comprises a metal frame which is mounted at a distance of approximately 500 mm from the vehicle. The frame comprises a plurality of horizontal struts or slats which are spaced apart at distance selected to prevent penetration by shaped-charge warheads. The slat armour functions as a preliminary shield, causing the premature detonation of shaped-charge warheads or, if caught between slats, disabling damage of the shaped-charge. Slat armour has been used by both the British Army, on the Warrior APC and the American Army, on the Stryker APC. One disadvantage of the slat armour is that it is relatively heavy and adds a great deal of weight to the already very heavy vehicle.

It is the object of the present invention to overcome some of the disadvantages of the prior art, or at least to offer an alternative system for counteracting the threat posed by RPGs.

According to the present invention there is provided textile armour comprising at least one textile section and corresponding supporting means, wherein the arrangement is such that the or each textile section is fully extended. The term "fully extended" describes the requirement that the or each textile section is free from sagging material when it is supported. The material should be supported at its full width, but it is not necessary for it to be taut. The reason for this requirement will be discussed in more detail below.

The textile armour according to the present invention is not armour in the conventional sense. Rather, it is specifically intended to be used to defend against shaped-charges, in particular to diminish the effectiveness, or cause deformation, of shaped-charges. As described above, the primary damage inflicted by a shaped-charge warhead, such as an RPG, is not caused by the explosion itself but by the shaped-charge jet which is generated. The primary function of the textile armour is to deform the nose cone of the shaped-charge, thus preventing the shaped-charge jet from forming properly. Furthermore, since the textile armour is intended to be deployed at a distance in the region of 500 mm from the target object which it is protecting, even if the warhead does function, the shaped-charge jet will be partly diffused when it reaches the target object. The present invention may be incorporated into armour systems to be fitted to military vehicles, in much the same way as the conventional slat armour. However, the present invention offers significant advantages, particularly in terms of weight reduction.

Preferably, the or each textile section comprises a net formed from a plurality of interconnecting net strands. The interconnecting net strands define a net mesh which may be of a variety of different shapes. The net mesh may be square, rectangular, triangular, circular, pentagonal, hexagonal octagonal or a combination of any of these shapes. The foregoing list is not exhaustive and the net mesh may conveniently be of any regular or irregular shape which may be formed into a net.

The objective of the textile armour is to prevent the shaped-charge jet from forming. When the or each textile section is in the form of a net the nose cone of the RPG will normally be received in a net mesh of the net. The nose cone is typically made from aluminum and the circumference of the net mesh will be selected such that it is smaller than the maximum circumference of the nose cone, such that the RPG cannot pass straight through the net. As it approaches the net the tip of the cone enters the net mesh. However, since the circumference of the net mesh is smaller than the circumference of the nose cone, the net mesh begins to tighten against the nose cone as it passes through, causing the net to strangulate the nose cone. As mentioned above, the nose cone is hollow and the strangulation causes the nose cone to crumple, which in turn causes the firing mechanism to fail and prevents the shaped-charge jet from forming. Once the nose cone has been strangulated the remainder of the RPG acts on the net mesh and will typically cause the mesh to break. However, the damage caused by the body of the RPG will only be that of a high speed projectile, which is not comparable to the potential damage caused by a shaped-charge. In most cases it will be necessary to repair or replace the textile armour after it has been hit. This is also the case in respect of the currently available slat armour.

It is preferred that the or each net section is supported at or near at least two adjacent corners, such that the body of the net hangs below. Extensive testing has revealed the surprising result that the net does not require to be securely supported in order to be effective. In a typical example, a RPG will be travelling at velocities up to 300 $ms^{-1}$. Without wishing to be bound by theory, it is believed that in the time-frame in which the net acts on the nose cone, the cone will be strangulated before the load has had a chance to be transferred to the perimeter of the net. In tests conducted using slow motion cameras it has been possible to view the interaction between the net and the RPG. As mentioned above, the nose cone crumples when the net mesh tightens around it. This renders the fuse inoperable and prevents formation of the shaped-charge jet. The remainder of the RPG then breaks through the net. It has been shown that at lower projectile velocities (in the region of 150 $ms^{-1}$) the RPG may be "caught" by the net and catapulted back. However, in order for this to happen the net must be securely supported by a strong frame.

The net strands may conveniently comprise plastic fibres. It is preferred that the plastic fibres are synthetic plastic fibres and have one or more of the following properties: high tenacity; low elongation; high strength to weight ratio; low density; and soft finish. As will be discussed in more detail below, it is desirable for the net strands to be thin. Consequently, suitable fibres must be high strength and high tenacity in order to perform the desired function. Similarly, the fibres must be made of a relatively low elongation material. If the fibres were made of a high elongation material then they would stretch on impact and may allow the nose cone to pass through and impact with the target. In order to improve handling it is desirable for the textile armour to be as light as possible.

Extensive testing has revealed that it is desirable for the fibres to be high strength but with a "soft and fluffy" finish. Although the term "soft and fluffy" does not describe technical features of the fibres it describes a desirable characteristic of them. In the event that a nose cone of a RPG hits one of the net strands directly it is preferred that the fibre is deflected and the nose cone continues into a net mesh, rather than firing and forming a shaped-charge jet. If the net strand has a "hard" finish then the possibility exists that the RPG will fire. It is therefore preferred that the fibres do not have a "hard" or resilient surface finish.

Although it is desirable for the fibres to have a "soft" finish, they must also be high strength and high tenacity as they need to be capable of strangulating the nose cone of a shaped-charge warhead before they fail. The net strands may suitably comprise ultra high molecular weight polyethylene fibres, such as Dyneema®. Alternatively, the net strands may be made from other high-strength man-made fibres, such as Kevlar®, Spectra® or any other suitable material.

Traditional nets tend to have knotted intersections where net strands are knotted in order to form the net mesh. It has been discovered that these knots form so-called "hard" surfaces which may cause a RPG to fire if it impacts directly onto the knot. Consequently, if a knotted construction is used then it is preferred that the knot is as small as possible to reduce the likelihood of a direct hit occurring.

The net preferably comprises a knotless mesh construction. Alternatively, the net may comprise a woven construction. In both of these constructions the intersections between nets strands are much less likely to cause a shaped-charge to fire if a direct hit occurs. It is believed that the particular construction of the net does not play any particular role in disabling the shaped-charge. The only consideration for the net construction is that the intersections are as small and "soft" as possible.

As discussed above, the primary function of the net strands is to strangulate the nose cone of a shaped-charge warhead and prevent it from firing. In order to perform this function it is preferred that the net strands are as thin as possible in order to increase the likelihood of the nose cone entering one of the net meshes, rather than hitting one of the net strands. It is a requirement of the invention that the net is "fully extended". The term "fully extended" describes the requirement that net is free from sagging material when it is supported. If the net material was permitted to sag then it would tend to bunch up, thus increasing the likelihood of a warhead hitting the net strands. Consequently, the net material should be held at its full extension, although it need not necessarily be taut.

As mentioned above, it is conceivable that if the tip of the nose cone hit directly onto one of the net strands then this may cause the RPG to fire. However, even if this was to happen the textile armour would still provide some protection as it will normally be located at least 50 cm from the target object which it is shielding. Consequently the shaped-charged jet will be formed at least 50 cm from the target and its effectiveness will be decreased.

It is preferred that the net strands have a diameter of less than 10 mm. More preferably, the net strands may have a diameter of less than 6 mm. The only limiting factor to the diameter of the net strands is the availability of materials from which to manufacture them. Ideally the net strands will have as small a diameter as possible. Using currently available materials it is preferred that the diameter of the net strands is in the range from 3-5 mm. As technology advances it is envisaged that it will be possible to utilise net strands having a diameter of less than 3 mm. The dimensions of the net strands are measured in accordance with BSI Aerospace Series Standard BS6F 100:1998.

As discussed above, the object of the textile armour is to disable a shaped-charge warhead, such as a RPG. This is achieved by strangulating the nose cone of the RPG, thus preventing it from firing. A number of different RPGs are currently available and it envisaged that over time more will be developed. The size of the warhead tends to vary between different RPGs. For example, a RPG-7 propels a warhead with a diameter of 85 mm and a RPG-18 propels a warhead with a diameter of 64 mm. Although a general form of the textile armour will be capable of disabling more than one size of warhead, such as the RPG-7 and the RPG-18, it is preferred that the textile armour is selected to counteract the specific threat, i.e. an RPG-7 specific textile armour.

It is preferred that the circumference of each individual mesh section of the net is less than the maximum circumference of the RPG warhead. This ensures that the RPG cannot pass straight through the net mesh. Each individual mesh section is defined as the shape defined by the intersection of the net strands. As discussed above, the mesh may be a variety of shapes, such as square, rectangular, triangular, circular, pentagonal, hexagonal octagonal or any combination of these shapes. The circumference of the net mesh is the total distance around the perimeter of the net mesh. For example, in a square net mesh with sides of 45 mm the circumference will be 180 mm.

It is further preferred that the circumference of each individual mesh section is less than, or equal to, two-thirds of the maximum circumference of the RPG warhead. This has been found to be the optimum mesh size which allows for as open a net as possible, while ensuring that the net is capable of strangulating the nose cone of an RPG warhead. It is believed that if the circumference of the mesh section is greater than two-thirds of the maximum circumference of the RPG warhead, then the possibility exists that the warhead will pass through the net and impact with the target object. It is also desirable to have as open a net as possible in order to minimise the likelihood of the warhead impacting with the net strands. Consequently, it has been discovered that the optimum circumference of each mesh section is two-thirds of the maximum circumference of the nose cone of the RPG which the net is designed to disable.

As discussed above the RPG-7 propels a warhead with a maximum diameter of 85 mm. The maximum circumference of such a warhead will be approximately 267 mm. Consequently, the optimum circumference of each mesh section in a textile armour designed to counteract the RPG-7 would be approximately 178 mm. In the case of a square net mesh this would require sides of approximately 45 mm. In the case of a square or rectangular net mesh the sides will typically be in the range from 20-100 mm.

It is preferred that the supporting means comprises a rigid support member. As discussed above, the net only requires minimal support in order to function. However, a rigid support member helps to ensure that the net is held in a "fully extended" manner. The rigid support member may conveniently be a frame structure.

The support member may be of a variety of shapes and its primary function is to suspend the textile section in order to provide a shield for a target object, such as a tank or APC, a building, a stockpile of munitions, a person or persons or anything else which may be subjected to enemy fire. The rigid support member may conveniently be a frame structure. The frame structure may be square, rectangular, circular, triangular, arched, pentagonal, hexagonal or any other regular or irregular shape which is capable of supporting a textile section. For example, the frame structure may comprise two upright posts connected by a cross bar.

The textile section may be suspended from a portion of the support member, such that it hangs down, or it may extend between two points on the support member, such that it is held taut.

It is preferred that the textile section is attached to the supporting member at a plurality of attachment points, and more preferred that the attachment points are evenly spaced along the supporting member.

The attachment between the textile section and the supporting member may be effected using any suitable attachment means, as will be easily understood by the person skilled in the art. The attachment may be permanent, semi-permanent or breakaway, and each attachment type has different properties which will be selected by the user. As discussed above, the primary objective for armour designed to counteract RPGs is to disable the warhead.

Although the net does not require support to function it is preferred from an operational point of view. It is envisaged that the textile armour will be fitted to armoured personnel carriers (APC) and the like in a similar manner to conventional slat armour. Fitting and replacement of the textile armour will be more easily facilitated if the textile armour is held within a frame. Although the frame need not provide support for the net in disabling RPGs, it must be strong enough to handle the daily wear and tear to which it will be subjected. For example, when it is fitted to an APC it is likely that the frame will be utilised by soldiers to enable them to climb on top of the APC.

In order to improve the functionality of the textile armour system it is preferred that the textile sections are provided with a camouflage colouring. More preferably, the textile sections may also be provided with a suitable camouflage garnish to compliment the colouring of the surroundings in which the system will be used. The use of such camouflage is well known.

According to a second aspect of the present invention, there is provided a textile armour system comprising a plurality of textile sections and a plurality of corresponding supporting means, wherein the arrangement is such that each textile section is fully extended.

The plurality of supporting means may conveniently comprise frame structures which may be connected together to form a framework of interconnected support members. The support members offer structural and inertial support for the system. The framework may be anchored to the ground, vehicle or other structure by any suitable means or secured in any other suitable way. The framework must be capable of providing the necessary support under impact from projectiles, such as RPGs. Although the textile armour is capable of disabling an RPG without support from a frame structure it has been shown that at lower velocities a frame structure can be helpful.

The textile armour system preferably comprises textile armour as described above. The textile armour system may conveniently be used to provide a screen between a target object and an incoming projectile. The target object may be a vehicle such as a tank or APC, a building, a stockpile of munitions, a person or persons or anything else which may be subjected to enemy fire. Although the system is specifically intended to be utilised to diminish the threat from shaped-charges, it may be deployed against other projectiles.

For a better understanding of the present invention reference will now be made to the accompanying drawings showing solely by way of example, an embodiment of the invention and, in which.

Figure 1:
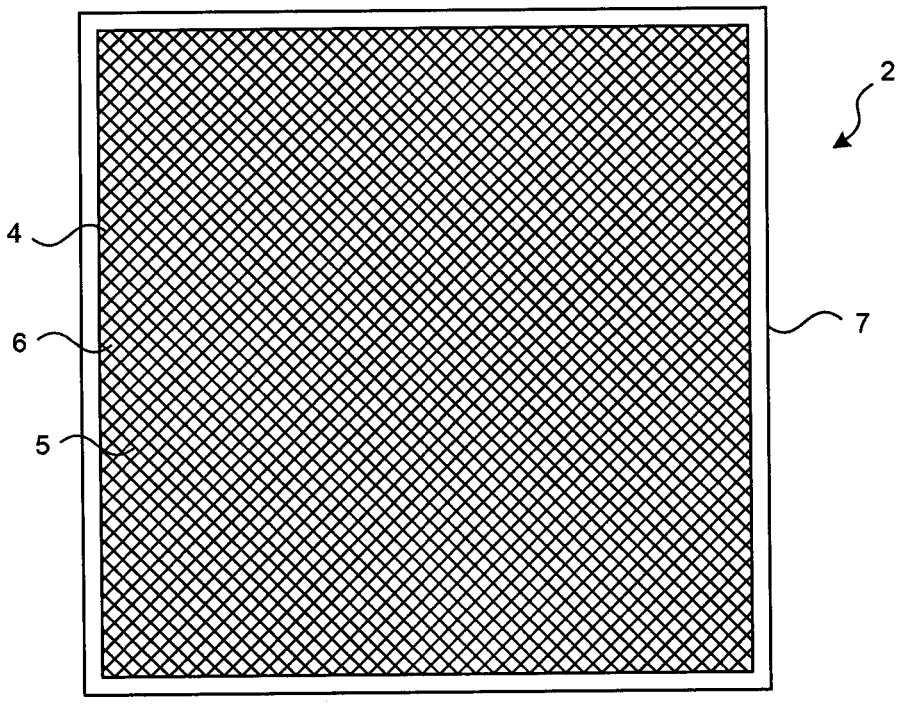
FIG. 1 shows a front view of a textile armour.

Referring firstly to FIG. 1, this shows a front view of a textile armour 2. The textile armour 2 comprises a textile section, in the form of a net mesh 4 formed by a plurality of interconnected net strands 5, 6, and supporting means in the form of a frame 7. The net strands 5, 6 forming the net mesh 4 are made of a high-performance polyethylene fibre manufactured by DSM and sold under the Dyneema® brand. It is preferred that the net strands are manufactured from plastic fibres having one or more of the following properties: high tenacity; low elongation; high strength to weight ratio; low density; and soft finish. Ideally, the plastic fibres will have all of the listed properties. The net strands 5, 6 must be sufficiently strong to ensure that the nose cone of an RPG is strangulated before they fail. The operation of the textile armour 2 will be described in more detail with reference to FIG. 3. Similarly, the net strands 5, 6 must exhibit relatively low elongation in the time frame in which they act on the nose cone. Typically, the textile armour 2 will be deployed at a distance of 500 mm from a target object and it is important that the net strands 5, 6 do not stretch under loading to the extent that an RPG could hit the target object before the textile armour 2 has acted to disable it.

Any suitable high-strength yarn may be used, in particular high-strength man-made fibres. For example, the net strands may be made from other high-strength man-made fibres, such as Kevlar®, Spectra® or any other suitable material which exhibits the desired properties. As discussed above, it is desirable for the net strands to have a "soft" finish. This does not mean that the net strands will break when hit by a high velocity projectile, rather it means that the projectile will push the net strand aside easily.

The net mesh is a square mesh with a mesh knot to knot size, or mesh dimension, of approximately 45 mm. The mesh knot to knot size must be small enough to ensure that RPGs are not permitted to pass through the net mesh 4 and this requirement will be discussed in more detail below. Although the mesh dimension is defined in relation to the "mesh knot to knot size", the net is actually constructed using a knotless intersection construction. The knot to knot size merely refers to the dimension of one side of the square net mesh. Although a square net mesh is utilised it is possible to manufacture the textile armour 2 using any shaped mesh, so long as the mesh size permits the textile armour 2 to function.

The operation of the textile armour 2 will be described in more detail in relation to FIGS. 2 and 3. However, a key feature of the textile armour 2 is the size of each individual mesh section. Each individual mesh section is defined as the shape defined by the interaction of the net strands 5, 6, which is square in the present case. Although the textile armour 2 may be utilised to counter the threat posed by more than one size of RPG, each net will be most effective against a particular size of RPG. In order to disable an RPG the textile armour 2 must be able to strangulate the nose cone. Consequently, the circumference of each section of net mesh is preferably no greater than two-thirds of the maximum circumference of the particular RPG.

In the present example the textile armour 2 is designed to disable an RPG-7 warhead. The RPG-7 warhead has a maximum diameter of 85 mm and a circumference of approximately 267 mm. In order to ensure that the warhead is disabled the circumference of each individual mesh section must be approximately 178 mm, which equates to a square mesh with sides of approximately 45 mm. Alternatively, it would be possible to use a rectangular mesh with sides of 60 mm and 30 mm.

The braid diameter of the net strands is 4.5 mm. It is preferred that the diameter of the net strands is as small as possible to limit the possibility of an RPG hitting a net strand.

The net mesh 4 is attached to a frame 7 by any suitable means. The net mesh is attached to the frame 7 at a plurality of points around the inner periphery of the frame 7. Testing has shown that at most velocities the frame structure 7 plays no part in disabling the RPG warhead. In fact, it is believed that at a velocity of 300 $ms^{-1}$ the warhead is disabled and the RPG has broken through the net mesh 4 before the load is transmitted to the frame 7. The frame 7 is manufactured from box steel. Although it plays no part in disabling the warhead it is preferred that the frame 7 is strong and resilient as it will typically be deployed in war time situations, such as additional armour for an APC, and it is likely to be subjected to some rough treatment, e.g. soldiers will climb on it. The frame 7 is provided with means (not shown) for connecting it to further frames in order to create armour of varying sizes to suit different applications. The frames 7 must be easy to replace as they will require repair when hit.

Figure 2:
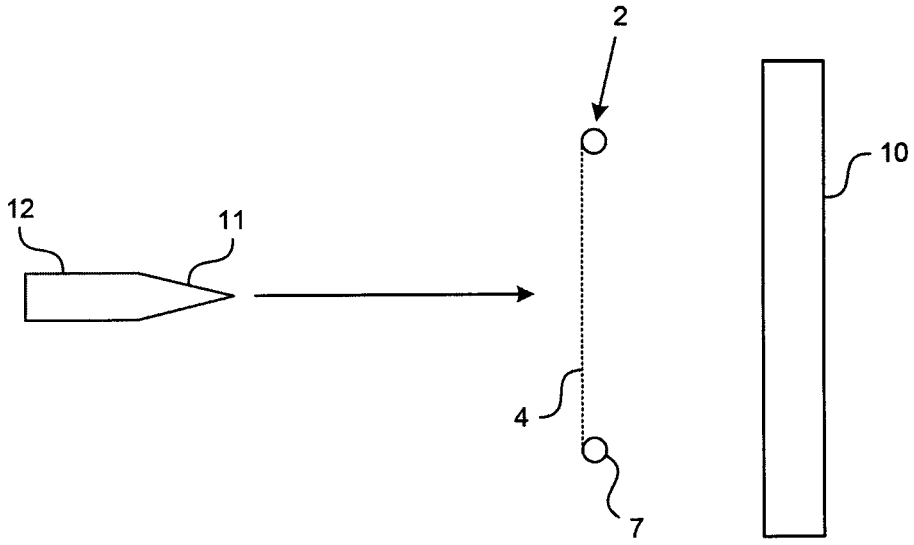
FIG. 2 shows a schematic sectional view of the textile armour of FIG. 1, before impact of a RPG warhead.

Referring now to FIG. 2, a RPG 12, is shown travelling towards the textile armour 2, in a direction perpendicular to the plane of the textile armour 2. The textile armour 2 is deployed at a distance of 500 mm from the target object 10, which may be an APC. The operation of the textile armour 2, as a result of the impact of the RPG 12, will be described with reference to FIG.

3.

Figure 3:
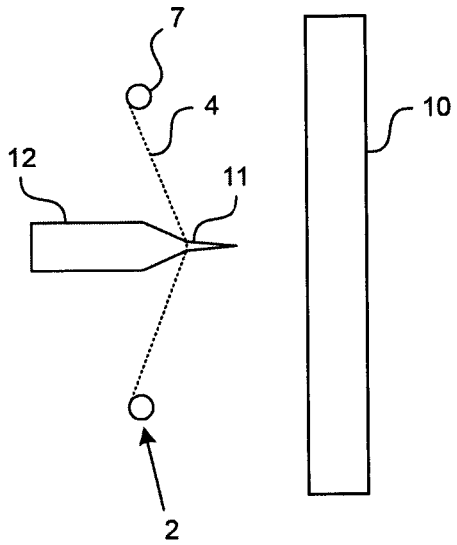
FIG. 3 shows a schematic sectional view of the textile armour of FIG. 1, after impact of a RPG warhead.

FIG. 3 shows the result of the impact of a RPG 12. The RPG 12 is an RPG-7 and has a maximum diameter of 85 mm and a typical velocity of 300 $ms^{-1}$. As discussed above, the nose cone of an RPG is hollow and is typically made from aluminium. The net strands 5, 6 of the net mesh 4 are very thin and there is more fresh air than material in the textile armour 2. This means that in normal circumstances there is a far greater likelihood that the tip of the nose cone 11 of the RPG 12 will enter into the space defined by a net mesh 4, rather than hit one of the net strands 5, 6. The circumference of each individual mesh section is approximately two-thirds of the circumference of the RPG 12. As the nose cone 11 passes through the net mesh it will reach a point at which the net mesh begins to tighten around it. The net mesh is made of high strength, high tenacity material and as it tightens it will strangulate the nose cone 11, causing it to crumple. This renders the RPG 12 inoperable and prevents it from firing and generating a shaped-charge.

The remainder of the RPG will then act on the net mesh and will eventually cause it to break. It is believed that this happens before the load can act on the frame structure 7. It will be necessary to replace the textile armour 2 after it has been hit.

In an alternative scenario the RPG 12 may hit directly onto one of the net strands 5, 6. The net strands 5, 6 are manufactured from a low density material with a "soft" finish and it is believed that when a direct hit occurs the net strand 5, 6 deforms out of the path of the RPG 12 tip and allows it to continue into a net mesh 4.

The textile armour 2 may be combined with other frame sections 7 to form a larger textile armour system. The textile armour system of the present invention is a versatile system which may be adapted to suit the needs of the user. The basic components of textile sections 4 attached to support members 7 may be combined in a variety of different ways to provide protection for a variety of objects 10. The many possible variations will be easily understood by the skilled person and the given examples merely show one possible embodiment.

The invention claimed is:

1. A method of defeating an RPG, the method comprising: attaching a frame to a vehicle or structure in a spaced relationship with respect to the vehicle or structure; attaching a net made of synthetic line to the frame, the net having a mesh size and configured such that when an RPG ogive impacts the net by passing through a net mesh, the net material collapses the RPG ogive rendering the RPG inoperable; and whereby when an RPG impacts the net material by passing through a net mesh, the net material collapses the RPG ogive rendering the RPG inoperable without explosive interactions.

2. The method of claim 1 in which a net mesh size between 30-60 mm is chosen.

3. The method of claim 1 in which a knotless weave of the line is chosen.

4. The method of claim 1 in which the net line diameter is between 0.5-3 mm.

5. The method of claim 1 including attaching two or more nets on the frame.

6. The method of claim 5 in which there is at least a first layer of smaller diameter line material and a layer of larger diameter line material.

7. The method of claim 6 in which there are between 2-4 layers of smaller diameter line material over a single layer of larger diameter line material.

8. The method of claim 1 in which the net frame is attached between 8"-48" from the vehicle or structure.

* * * * *